US005141364A

United States Patent [19]

Degen et al.

[11] Patent Number: 5,141,364

[45] Date of Patent: Aug. 25, 1992

[54] METHOD AND DEVICE FOR PRODUCING A NARROW OR SLIT WALL IN SOIL

[75] Inventors: Wilhelm S. Degen, Horgen, Switzerland; Alexander Degen, Schwindegg, Fed. Rep. of Germany

[73] Assignee: Vibroflotation AG, Altendorf, Switzerland

[21] Appl. No.: 752,358

[22] Filed: Aug. 30, 1991

[30] Foreign Application Priority Data

Aug. 31, 1990 [DE] Fed. Rep. of Germany ..... 4027596

[51] Int. Cl.[5] ..... E02D 15/02; E02D 5/18

[52] U.S. Cl. ..... 405/240; 405/233; 405/267; 405/269

[58] Field of Search ..... 405/233, 240, 241, 266, 405/267, 269

[56] References Cited

U.S. PATENT DOCUMENTS 1,665,798 4/1928 Sipe ..... 405/267
4,906,142 3/1990 Taki et al. ..... 405/267

FOREIGN PATENT DOCUMENTS 1167754 4/1964 Fed. Rep. of Germany .
2236901 2/1973 Fed. Rep. of Germany .
2534611 4/1984 France ..... 405/233
51330 3/1982 Japan ..... 405/267

*Primary Examiner*—Randolph A. Reese
*Assistant Examiner*—Arlen L. Olsen
*Attorney, Agent, or Firm*—Mason, Fenwick & Lawrence

[57] ABSTRACT

Method for producing a narrow or slit wall (42) in soil (22) by means of a driver (10) with at least two and preferably three vibrating tubes (I, II, III) and guide blades (28, 30, 32) between the vibrating tubes. Following penetration of the driver into the soil, during the withdrawal process of the latter, injection material (40, 44) is loaded into the drilled cavities. During the next work step, the driver is lowered into the soil so that the rearmost vibrating tube (I) is lowered into the still-soft injection material (40) which was added during the previous withdrawal of the foremost vibrating tube (III). By monitoring the power draw of the vibrating motor on the rearmost vibrating tube (I) and regulating this power draw to keep it to a minimum value, removal of the rearmost vibrating tube from the still-soft injection material (40) is prevented. As a result the seal between the successive sections of narrow wall (42) is ensured. Continuous abutting of the paths (40, 44) produced by the individual vibrating tubes ensures the tightness of each wall section.

12 Claims, 1 Drawing Sheet

METHOD AND DEVICE FOR PRODUCING A NARROW OR SLIT WALL IN SOIL

BACKGROUND OF THE INVENTION

The invention relates to a method for producing a narrow or slit wall in the soil as well as a device for its working.

A method of this kind is already known from DE-OS 2 236 901, with the driver used for this purpose having three vibrating tubes supported by a common header with guide blades near their lower ends In the known method, reliable assurance cannot be provided that the individual wall segments which follow one another in the construction direction of the narrow wall and are prefabricated by penetration and withdrawal of the drivers, abut one another continuously to form a continuous watertight narrow wall. A tight seal between the individual paths prefabricated by a vibrating tube in each wall section is not ensured either. As a result of minor changes in direction during penetration of the drivers, caused primarily by irregular characteristics of the soil, gaps can occur between the successive wall sections or paths, whose presence cannot be determined or can be determined only after completion of the narrow wall as a result of the seepage of water or other liquids.

U.S. Pat. No. 4,906,142 teaches a method in which two parallel soil borers mix soil with a curing material, whereby, to produce a continuous solidified wall, one of the two soil borers, at its next penetration stroke, penetrates the borehole drilled on the previous stroke by another soil borer and filled with material to be cured. This is intended both to ensure mutual contact between the wall sections produced in successive strokes and also to ensure good mixing of soil and curing material when a soil borer penetrates once more into the same borehole. An inadvertent lateral deviation of one or both soil borers from the intended parallelism and the consequent leakage in the wall to be produced cannot be determined in this method.

SUMMARY OF THE INVENTION

The invention is intended to provide a method and a device by which a tight mutual contact between successively produced sections of a narrow wall or of a thicker slit wall, as well as between the individual paths of each wall section, is reliably ensured.

As a result of the insertion of the rearmost vibrating tube into the still-soft injection material, for example concrete or the like, in the borehole drilled and filled by the foremost vibrating tube during the previous penetration step of the driver, the vibrating movement of this rearmost vibrating tube encounters only a very slight resistance as long as it does not depart laterally from the borehole. This slight resistance to vibrating movement corresponds to a relatively small power draw in the corresponding vibrating motor. However, as soon as the rearmost vibrating tube, as a result of excessive displacement of the driver or because of an inclined position of the latter, strikes one of the more solid walls formed by the abutting soil, the value of the current drawn by the vibrating motor increases abruptly. By immediately correcting the position and/or direction of the driver, the power draw is again reduced to a minimum value, thus ensuring that there is a tight connection between the wall section produced by the two forward vibrating tubes and the guide blades against the wall section produced previously. In addition, the continuous contacts between the individual paths also ensure tightness within each section.

The method according to the invention can be worked with only two vibrating tubes supported by a header. It is preferable to use three vibrating tubes, but the invention is not limited to this; rather, even more parallel vibrating tubes on a common header can be used without significant disadvantages for simultaneously producing longer narrow or slit wall sections.

Keeping the power draw to a minimum can be accomplished both by visually monitoring a current measuring device at the driver's seat of the vehicle or crane supporting the header and actuating mechanical correcting devices, or, by automatically monitoring using regulating devices well known to the individual skilled in the art.

The escape of injection material from the rearmost vibrating tube upon withdrawal is usually regulated automatically by the prevailing pressure conditions. However, to avoid overswelling of injection material and an excessive pressure increase in the rearmost vibrating tube, the escape of injection material can be prevented at least temporarily, for example toward the upper extreme of the extraction process.

Monitoring of the power draw in the motor of the rearmost vibrating tube can also be accomplished by recording using a strip chart recorder, for example an ampere depth recorder.

To work the method according to the invention, a driver with at least two and preferably three vibrating tubes is proposed, whereby guide blades are advantageously provided only in the spaces between each two vibrating tubes with their lateral ends, said blades being connected together to absorb the differential vibration of the vibrators either through a flexible rubber-metal sleeve or through loose meshing with one another, and whereby an endwise, in other words first or last, vibrating tube is provided with a device to measure the power draw of the corresponding vibrating motor. Therefore, when there are three vibrating tubes, only the middle one has a guide blade projecting forward and backward, while the forward vibrating tube has only one guide blade pointing backward and the rearmost tube has only one blade pointing forward. The overlap ensures a continuous contact between the extruded injection materials. The lateral ends or edges can mesh with one another using a type of tongue and groove joint so that the vibrating tubes are always kept roughly in a single plane.

In certain cases, the meshing guide blades can also be welded together so that steering corrections to be made on the driver are always transmitted uniformly to all the parts thereof.

While it is sufficient in certain types of soil for the guide blades to generate cavities which are then filled by the injection material emerging from the vibrating tubes, in certain cases the guide blades can also be connected to the feed devices for the injection material and can have nozzles for insertion of the injection material.

The rate of penetration of a vibrating tube into the ground increases inversely with its diameter, directly with its vibrating frequency, and directly with its vibration amplitude. Vibrating drivers known heretofore have been optimized for both penetration rate and compression effect. However, for compression a large diameter and a low frequency are desirable. Usually therefore the prior art chooses for the vibrating tubes, diameters in the range from 300 to 400 mm, a vibration amplitude of 8 to 23 mm, and a vibration frequency of up to 3000 rpm. The total effect of the vibrating driver in working the method according to the invention can be considerably improved if the diameter of a vibrating tube is kept within the range from approximately 200 to 250 mm, preferably 230 mm, the vibration amplitude is kept in the range from approximately 7 to 8 mm, and the vibration frequency is kept in the range from approximately 3600 to 4000 rpm.

An embodiment of the invention for producing a narrow wall will now be described in greater detail with reference to the figures.

DESCRIPTION OF THE PREFERRED EMBODIMENTS

Figure 1:
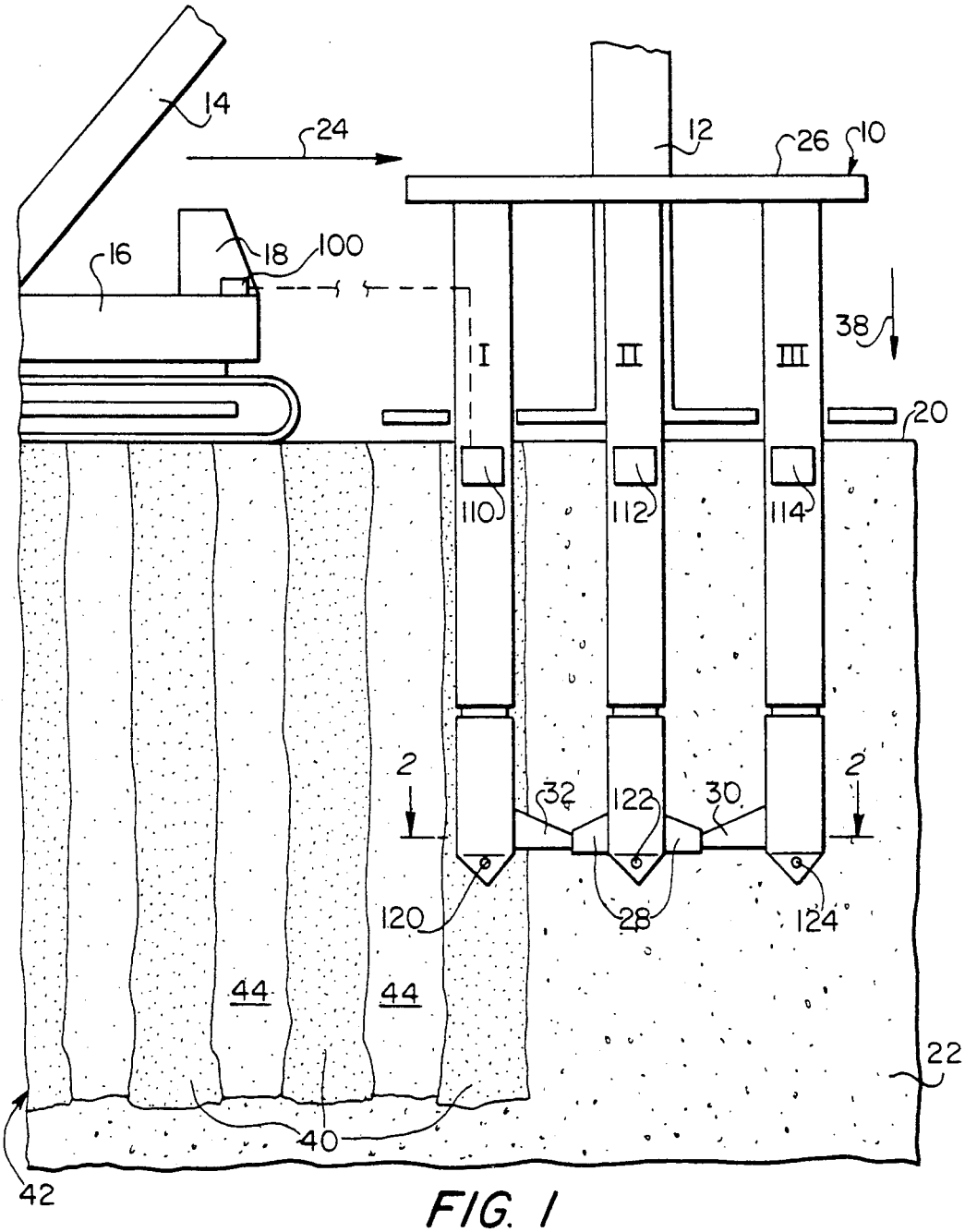
FIG. 1 is a schematic cross section through the soil during the penetration of a vibrating driver according to the invention into the latter.

The driver, generally designated by 10, is supported by a header 12 suspended in a manner not shown from a cross arm 14 of a crane 16 with cab 18. Crane 16 travels forward on the surface 20 of soil 22 in working steps in working direction 24.

Figure 2:
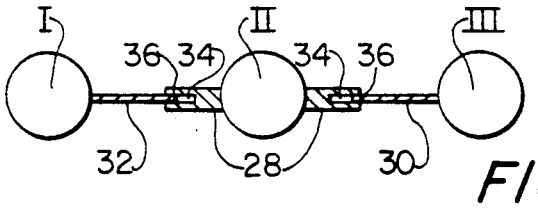
FIG. 2 is a section along line II—II in FIG. 1.

Driver 10 has a frame 26 vertically displaceable on header 12 and having three parallel vibrating tubes I, II, and III. Each vibrating tube has feed devices known of themselves in its interior for injection material as well as vibrating motors, 110, 112, 114 with their electrical leads. The lower ends of vibrating tubes I, II, and III are made conical, likewise in a manner known of itself. Middle vibrating tube II has one guide blade 28 directed forward and another directed rearward near its lower end, while forward vibrating tube III has only one guide blade 30 pointing rearward and rear vibrating tube has only one guide blade 32 pointing forward. As can be seen in the schematic diagram in FIG. 2, in which all the interior details of the vibrating tubes have been omitted, lateral ends 34 of guide blades 30 and 32 fit into matching grooves 36 in guide blades 28 and are welded to the latter or guided loosely therein.

The point in time in the process shown in FIG. 1 shows driver 10 during the phase of penetration in the direction of arrow 38. During the previous withdrawal of driver 10, the three paths marked 40 of the narrow wall produced previously and generally designated by 42 were drilled by the three vibrating tubes and filled through lines and nozzles 120, 122, 124 near the lower ends of vibrating tubes I, II, and III and guide blades 28, 30, and 32, while two paths 44 were drilled between them by guide blades 28, 30, and 32 and filled with injection material. After completion of withdrawal, crane 16 was driven forward in working direction 24 to the point where rearmost driver I was located above foremost path 40. At this point the penetrating movement of driver 10 in the direction of arrow 38 begins. Forward vibrating tubes II and III then penetrate soil 22 with their guide blades while rearmost vibrating tube I is lowered into the foremost path of the still-soft injection material. The corresponding guide blade 32 then partially penetrates soil 22. As long as vibrating tube I remains inside path 40, the power draw on the corresponding vibrating motor 110 is low. However, it rises sharply immediately after vibrating tube I emerges from path 40 of the still-soft injection material and enters dense soil 22. When a current increase is observed on current measuring device 100, a directional correction of driver 10 is immediately made so that rearmost vibrating tube I is again lowered into the soft injection material. Thus, reliable overlap of abutting sections of narrow wall 42 can always be ensured.

We claim:

1. A method for producing a narrow or slit wall comprising:

providing a driver having a header and at least two vibrating tubes depending from the header, the vibrating tubes having joined earth-penetrating guide blades at their lower ends in a common plane, inserting said vibrating tubes into the ground and withdrawing said vibrating tubes from the ground to form cavities in the ground by said tubes and guide blades, feeding hardenable injection material from said vibrating tubes into said cavities during withdrawal of said vibrating tubes, thereafter moving the driver in the direction of the line of cavities and inserting the vibrating tubes into the ground with a said vibrating tube entering a cavity having unhardened injection material therein fed from a said vibrating tube, and another said vibrating tube forming an additional cavity, causing the cavities produced by the vibrating tubes and the guide blades to abut one another to form a continuous hardened, cured narrow or slit wall comprising:

(a) measuring the power drawn by the electric motor in the vibrating tubes during penetration into the cavity with unhardened injection material therein; and (b) maintaining the power drawn by the electric motor at a minimum by correction of at least one of the position and penetration direction of the driver.

2. The method of claim 1, and further comprising the step of sensing any increase in the value of the power drawn and in response thereto causing said correction by correction apparatus.

3. The method of claim 1, and further comprising partially blocking the escape of injection material from the vibrating tube which is in a cavity having injection material therein.

4. The method of claim 1, and further comprising recording the power drawn by said electric motor.

5. The method of claim 1, and further comprising causing said vibrating tubes to vibrate at a vibrational amplitude of approximately 7 to 8 mm and at a vibrational frequency of approximately 3600 to 4000 rpm.

6. Apparatus for forming a narrow or slit wall comprising:

a driver having a header and at least two vibrating tubes depending from said header, an electric vibrator motor in each said tube, earth penetrating guide blades extending from said tubes and forming a continuous structure extending between adjacent tubes, said guide blades being the only guide blades provided on said vibrating tubes, means connecting together the guide blades of adjacent tubes, nozzles for injecting injection material at the lower ends of said vibrating tubes, and current measuring means for measuring the power draw of the electric vibrating motor located in an end one of said vibrating tubes.

7. The apparatus of claim 6, wherein said connecting means comprises a flexible sleeve comprising rubber.

8. The apparatus of claim 6, wherein said connecting means comprises means for loosely meshing components thereof.

9. The apparatus of claim 6, wherein said connecting means comprises a tongue and groove joint.

10. The apparatus of claim 9, and weld means for connecting said tongue and groove joint.

11. The apparatus of claim 6, and further comprising nozzles for injecting injection material at the lower ends of said guide blades.

12. The apparatus of claim 6, wherein said vibrating tubes have a diameter of approximately 200 to 250 mm.

* * * * *